US007611763B2

(12) United States Patent
Atsma et al.

(10) Patent No.: US 7,611,763 B2
(45) Date of Patent: Nov. 3, 2009

(54) YARN FOR AN ARTIFICIAL TURF GROUND COVER, ARTIFICIAL TURF GROUND COVER AND PLAYING FIELD INCLUDING SUCH A YARN AND METHOD FOR PRODUCING SUCH A YARN

(75) Inventors: Franke Atsma, Woudsend (NL); Durk Wildschut, Wijckel (NL)

(73) Assignee: Lankhorst Indutech B.V., Sneek (NL)

( * ) Notice: Subject to any disclaimer, the term of this patent is extended or adjusted under 35 U.S.C. 154(b) by 326 days.

(21) Appl. No.: 10/558,447

(22) PCT Filed: May 28, 2003

(86) PCT No.: PCT/NL03/00401

§ 371 (c)(1),
(2), (4) Date: Nov. 15, 2006

(87) PCT Pub. No.: WO2004/106601

PCT Pub. Date: Dec. 9, 2004

(65) Prior Publication Data

US 2007/0166507 A1 Jul. 19, 2007

(51) Int. Cl.

| | |
|---|---|
| ***B32B 33/00*** | (2006.01) |
| ***E01C 13/08*** | (2006.01) |
| ***D02G 3/02*** | (2006.01) |
| ***D02G 3/06*** | (2006.01) |
| ***D02G 3/22*** | (2006.01) |
| ***D02G 3/44*** | (2006.01) |

(52) U.S. Cl. ..... 428/97; 428/17; 428/92; 428/373; 428/374; 428/397; 428/399; 428/400

(58) Field of Classification Search ..... 428/357, 428/364, 373, 374, 397, 400, 92, 97, 88, 428/89, 85, 17, 483, 515, 399, 358; 264/173.11, 264/173.12, 173.15, 210.1, 210.7
See application file for complete search history.

(56) References Cited

U.S. PATENT DOCUMENTS 5,045,598 A 9/1991 Duez et al.

(Continued)

FOREIGN PATENT DOCUMENTS

DE 20321491 U1 * 7/2008

(Continued)

OTHER PUBLICATIONS www.waybackmachine.org—2 page printout of archived information from the www.gras-tex.com website, Oct. 2, 2002.

*Primary Examiner*—Cheryl Juska
(74) *Attorney, Agent, or Firm*—Pearne & Gordon LLP

(57) ABSTRACT

A yarn for strands of an artificial turf ground cover, including a tape filament (4) having a core layer (8) and two outer layers (9) of a different material than the core layer (8), each on one of two opposite sides of the core layer. The core layer (8) contains at least polyester or polyolefin material, and the outer layers (9) contain high-density polyethylene. An artificial turf ground cover and a playing field including such a yarn and a method for producing such a yarn are also described. The high-density polyethylene has a relatively small coefficient of friction with the human skin and the yarn has a good shape recovery after deformation in spite of containing HDPE in outer layers.

13 Claims, 1 Drawing Sheet

U.S. PATENT DOCUMENTS

| | | | | |
|---|---|---|---|---|
| 6,045,923 | A | 4/2000 | Kok et al. | |
| 6,596,352 | B2 | 7/2003 | Weder | |
| 6,815,059 | B2 * | 11/2004 | Slootweg et al. | 428/364 |
| 6,881,793 | B2 * | 4/2005 | Sheldon et al. | 525/240 |
| 7,318,961 | B2 * | 1/2008 | Loos et al. | 428/516 |
| 2002/0081399 | A1 | 6/2002 | Prevost et al. | |
| 2002/0091011 | A1 * | 7/2002 | Sosin | 473/278 |
| 2002/0109255 | A1 | 8/2002 | Weder et al. | |
| 2004/0219308 | A1 | 11/2004 | Prevost et al. | |
| 2004/0229007 | A1 | 11/2004 | Motz et al. | |
| 2007/0154661 | A1 * | 7/2007 | Stroppiana | 428/21 |
| 2007/0166507 | A1 * | 7/2007 | Atsma et al. | 428/85 |
| 2008/0044598 | A1 * | 2/2008 | Stroppiana | 428/17 |
| 2008/0044599 | A1 * | 2/2008 | Stroppiana | 428/17 |
| 2008/0063846 | A1 * | 3/2008 | Loos et al. | 428/212 |
| 2008/0090955 | A1 * | 4/2008 | Lambert et al. | 524/543 |
| 2008/0254281 | A1 * | 10/2008 | Chen et al. | 428/335 |
| 2008/0257482 | A1 * | 10/2008 | Jeruzal et al. | 156/188 |
| 2008/0261471 | A1 * | 10/2008 | Chen et al. | 442/60 |
| 2008/0265457 | A1 * | 10/2008 | McLeod et al. | 264/255 |
| 2008/0280075 | A1 * | 11/2008 | Van Reijen | 428/17 |
| 2009/0011152 | A1 * | 1/2009 | Stroppiana | 428/17 |

FOREIGN PATENT DOCUMENTS

| | | | | |
|---|---|---|---|---|
| EP | 0 259 940 | | | 9/1987 |
| EP | 0301843 | A1 | | 7/1988 |
| EP | 0 417 832 | | | 9/1990 |
| EP | 0 776 762 | | | 11/1996 |
| EP | 1 277 573 | | | 7/2001 |
| EP | 1378592 | A1 | * | 1/2004 |
| JP | 7048778 | | | 2/1995 |
| JP | 07310250 | A | * | 11/1995 |
| JP | 9119036 | | | 5/1997 |
| JP | 11269811 | | | 10/1999 |
| JP | 2003342848 | A | * | 12/2003 |
| WO | WO 98/56993 | | | 6/1998 |
| WO | WO 99/04074 | | | 1/1999 |
| WO | WO 03/008190 | | | 1/2003 |
| WO | WO 2004106601 | A1 | * | 12/2004 |
| WO | WO 2005/058425 | | | 6/2005 |
| WO | WO 2005111281 | A1 | * | 11/2005 |

* cited by examiner

YARN FOR AN ARTIFICIAL TURF GROUND COVER, ARTIFICIAL TURF GROUND COVER AND PLAYING FIELD INCLUDING SUCH A YARN AND METHOD FOR PRODUCING SUCH A YARN

TECHNICAL FIELD

This invention relates to a yarn for an artificial turf ground cover, to an artificial turf ground cover including such a yarn and to a playing field including such a yarn and to a method for producing such a yarn.

BACKGROUND ART

Artificial turf—also known as artificial grass or artificial lawn game playing field—is usually provided as a carpet-like ground cover typically having more or less upright single filament or multifilament strands fastened to a substrate sheet and projecting upwardly from that sheet. The strands may be formed of thin, flat yarn of plastic material. The strands may be gathered into tufts that are fastened to the substrate sheet. The substrate sheet usually has a textile or textile-like structure and is usually made of plastic material as well.

Such ground covers usually cover a ground surface to form a game playing field and generally serve as a replacement for a natural grass ground cover, or other conventional playing field surface, which is less resistant to intensive use, requires more maintenance and generally forms a less uniform and more uneven surface.

A resilient underpad may be placed beneath the carpet and upon the firm ground support surface to provide a shock absorbing effect. Also known is the use of granular fillers on the substrate sheet and around the strands to promote an upright position of the strands. An example of such an artificial turf ground cover is described in international patent application WO98/56993.

The strands of such artificial turf type ground covers have to meet several requirements. One requirement is resilience, i.e. the strands have to spring back after having been pressed flat against the ground, for instance by the foot of a player, and the strands should be capable of springing back quickly and repeatedly. Also, especially for playing soccer, the strands should be sufficiently stiff to keep a ball lying thereon sufficiently spaced above the substrate layer. To meet these requirements, the strands are usually made of flexible, resilient materials that regains its original shape, also after important deformations, such as polypropylene, linear low density polyethylene or a block copolymer of polypropylene and polyethylene. Another requirement is that the strands have a good durability. In particular, the strands should not fibrillate too easily. Yet another requirement is that the friction coefficient between the strands and the human skin should not be too large to avoid skin-burns on human skin sliding over the grass. Especially, with respect to the latter property, improvement is still desired to make artificial turf attractive as a replacement for natural turf for games and other purposes, such as use a playground for children, which involve or may involve frequent sliding skin-grass contact such as soccer.

In European patent application 0 259 940, an artificial grass having a lower coefficient of friction than grass consisting of polypropylene strands is proposed. It is described to add polyethylene terephtalate to the polypropylene or to manufacture the strands of the grass of co-extruded multi-layered tape including an inner layer of polypropylene between outer layers of linear low-density polyethylene. Linear low-density polyethylene has a lower coefficient of friction than polypropylene and is known by itself as a material from which the strands may be manufactured. It is further described that, in addition, use can be made of polyethylene terephtalate that possesses a low coefficient of friction and has a (small) moisture absorbing capacity. However, such grass is relatively soft, which seems to have an adverse effect on load distribution such that relatively high normal pressures occur when a player falls on the grass. In combination with a still quite important grass-skin friction coefficient, this tends to cause skin abrasions upon sliding contact between the skin and the grass.

In international patent application WO 99/04074, it is proposed to combine polyamide and a polyolefin compound selected from the group consisting of polypropylene, linear low-density polyethylene and a block copolymer of polypropylene and polyethylene in a yarn for artificial turf. More in particular, co-extruded filaments are described, which contain a core layer or outer layers of polypropylene, linear low-density polyethylene or a block copolymer of polypropylene and polyethylene and outer layers or, respectively a core layer of polyamide. It is also described in this document to use yarns other than monofilaments, preferably, on the one hand, fibrillated yarn of the block copolymer of polypropylene and polyethylene, fibrillated yarn of high density polyethylene, fibrillated yarn of linear low density polyethylene or fibrillated yarn of polypropylene and, on the other hand, fibrillated polyamide yarn. However, also artificial turf made of such multifilament yarns does not reduce friction to the human skin to a sufficient degree for use as for example a soccer field. Furthermore, recovery of high-density polyethylene filaments after large deformations, such as pleating under the foot of a player, is poor.

In European patent application 0 417 832 it is described that after-fibrillation and the associated wearing-out of an artificial turf ground cover can be reduced by using fibres cut from extruded film, which have been stretched at a ratio of at most 1:2 to 1:3. However, this goes at the expense of fibre strength and stiffness that can be achieved at higher stretch ratio's, so that relatively much fibres material is required to achieve the desired overall firmness (i.e. ball carrying capacity) of the artificial turf surface.

SUMMARY OF THE INVENTION

It is an object of the present invention to provide a yarn for manufacturing strands of an artificial turf ground cover that exhibits a lower coefficient of friction to the human skin, yet is stiff and resilient enough to exhibit good firmness and recovery even after repeated deformation.

According to the present invention, this object is achieved by providing a yarn according to claim 1. The invention can also be embodied in an artificial turf ground cover according to claim 10, in which the strands are made of such yarn, to a playing field according to claim 11, which includes such an artificial ground cover and in a method according to claim 12 for manufacturing such a yarn.

It has been found that, when combined with a core of a stretched material that exhibits a better recovery after larger deformations than stretched high density polyethylene, the provision of outer layers of high density polyethylene, even though located in the portion of the yarn that is subjected to the largest deformations when the strands are bent, results in strands that do not suffer significantly from the relatively poor recovery from large deformations that is normally associated to stretched high density polyethylene. Since the friction coefficient of high-density polyethylene to the human skin is low, an artificial turf with a particularly low friction relative to the human skin is obtained, that avoids the poor recovery after deformations normally associated with high-density polyethylene.

Particular embodiments of the invention are set forth in the dependent claims.

Further aspects, effects and details of the invention are described in the detailed description with reference to the drawings.

MODES FOR CARRYING OUT THE INVENTION

The invention is first described with reference to presently most preferred embodiments of the invention.

Figure 1:
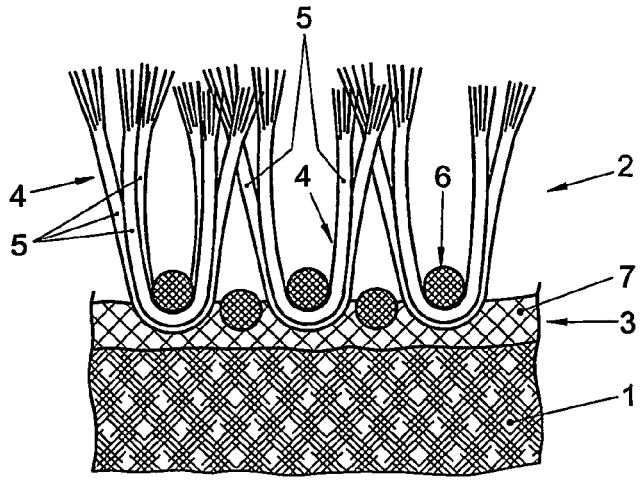
FIG. 1 is a schematic end view in cross-section of a sample of an example of a synthetic turf playing field according to the invention.

The sample of an artificial playing field shown in FIG. 1 includes a ground portion 1 and an artificial turf ground cover 2 covering the ground. Additional layers may be provided between the ground 1 and the cover 2, for instance for levelling out irregularities in the ground, for cushioning and/or for absorbing moisture. The artificial turf cover 2 according to this example consists of a backing 3 and closely spaced, tufts 4 formed of U-shaped, flat, narrow bent strips or strands 5 that form artificial grass blades. The strands 5 are fastened upon the backing that is composed of a fabric 6 and a binder layer 7. The fabric may for instance be manufactured of weather resistant, plastic such as polypropylene or nylon fibre material.

The tufts 4 are inserted around or through the fibres forming the base sheet and held in place by the adhesive material of the binder layer 7 in which the fabric 6 and the tufts 4 are partially embedded. The ends of the strands 5 that project upwardly from the backing 3 may for instance be fibrillated as is shown to give the artificial turf a more smooth appearance, softer tactile properties and to improve its liquid retaining properties. Also a profiled cross-section can be provided to further enhance smooth appearance and soft tactile properties The height of the pile measured from the backing 3 is preferably between 1 and 8 centimeters. If the pile is relatively high, it may be useful to partially fill in the pile with a filler such as sand and/or rubber or other granules so that the strand are less easily pressed completely flat against the backing. The width of the strands 5 is preferably between 0.5 and 20 mm, relatively wide strands preferably being provided in the form of tape obtained from film with longitudinal grooves and ribs (see FIG. 3). The number of blades per tuft 4 is preferably between 1 and 12. The thickness of the yarn is preferably about 0.04 to 0.2 mm. If the tufts are made of profiled tape with grooves 60 and ribs 61, the blades easily cleave until adjacent the fabric 6 into larger numbers of blades in use or as a result of a special processing step. This allows for instance to obtain a fine turf while processing only a limited number of tapes, for instance one to three or up to six tapes per tuft.

Figure 2:
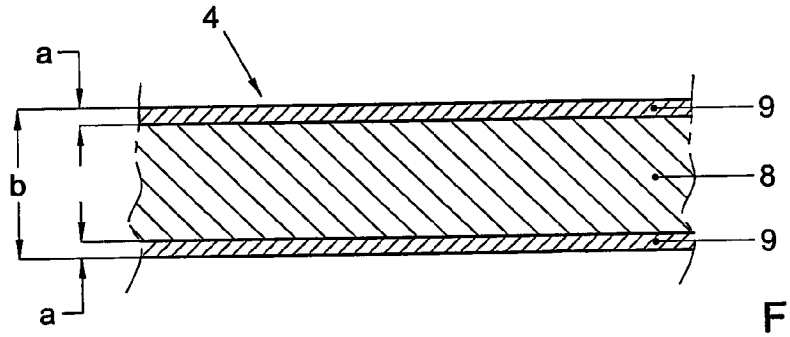
FIG. 2 is an enlarged view in cross-section of a sample of an example of a monofilament yarn according to the invention.

The yarn for the strands 5 of the artificial turf ground cover 2 according to the example shown in FIG. 1 is a yarn formed by a single filament 4 cut or cleaved from tape having a core layer 8 and two outer layers 9, each on one of two opposite sides of the core layer 8 (FIG. 2). The outer layers 9 are of a different material than the core layer 8. The core layer 8 contains at least polyester or polyolefin material, and the outer layers 9 each contain high-density polyethylene (HDPE). Since the yarn is of a monofilament construction, twining of yarns is not necessary to manufacture the strands and there is no possibility of accelerated wear due to untwining of the strands.

Manufacturing the yarn according to the present example includes extruding the core layer 8 the outer layers 9 and bringing the layers in a multilayer configuration with the core layer 8 between two of said outer layers 9. Extrusion of the layers 8, 9 is preferably carried out simultaneously by co-extruding the layers.

If a player's skin slides over the artificial turf cover 2 according to the present example, the skin virtually only contacts HDPE material on the outside of the tape-shaped strands 5. HDPE has a very low coefficient of friction with human skin material, so that the risk of injury and notably skin-burns is relatively low. In spite of the use of stretched HDPE in the outside layers of the tape-shaped filament material, which material recovers relatively poorly after large deformations, an artificial turf with a yarn as proposed shows a recovery similar to that of yarn made of the core material alone, this in spite of the HDPE being located in the portion of the material most remote from the neutral line during bending of the strand 5.

Furthermore, the durability of the artificial turf is improved, because the HDPE layers reduce the tendency of the material to fibrillate in use.

The core layer preferably contains polypropylene, a mixture of polypropylene and rubber, a block copolymer of polypropylene and polyethylene or linear low-density polypropylene, or polyethylene terephthalate. Thus, a good adhesion between the layers is obtained which is also advantageous in assisting recovery of the HDPE outer layers after large deformations. This helps to counteract permanent deformations of the strands.

For good shape recovery of the strands 5, it is further advantageous if the total thickness of the outer layers is at most 50% and preferably at most 15 to 25% of the thickness of the multilayer material. Even if permanent deformations of the outer layer occur, the influence on the overall shape of the strand remains relatively limited, because the thinner the outer layers 9 are, the further the core layer 8 urges the strand 5 back to at least close to its original posture in the event of permanent deformation of the outer layers 9. It is therefore also advantageous if the thickness of each of the outer layers is less than 50 μm and preferably less than 20 μm. Furthermore, for accommodating a relatively thick core layer, a minimum overall thickness of the yarn of at least 100 μm is advantageous.

The material according to the present example has been stretched in longitudinal direction at a stretching ratio of 1:6. By stretching, preferably at a stretching ratio of at least 1:3 to 1:4, the tensile strength of the material, and accordingly the bending loads at which the material is deformed permanently are increased. Furthermore, core materials such as polypropylene tend to after-fibrillate too easily after having been stretched. The HDPE outer layers protect the yarn against such after-fibrillation, so that stretching can be applied without the known disadvantage of increased after-fibrillation.

Figure 3:
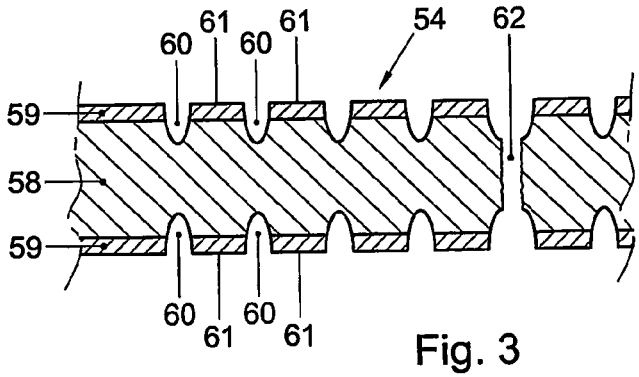
FIG. 3 is a schematic, enlarged view in cross-section of a sample of another example of a monofilament yarn according to the invention.

A schematic representation of a tape 54 for forming a multi-strand tuft 54 in which the HDPE outer layers are interrupted by grooves 60 is shown in FIG. 3. The tape 54, which in reality will generally be of a smoother shape, has a pattern of parallel, longitudinal, alternating ribs 61 and grooves 60 on each of its two opposite sides. The grooves 60 in one side of the extruded tape 54 are each located diametrically opposite a groove 60 in the other, opposite side of the tape 54.

The tape 54 with grooves 60 in its surfaces is preferably cut from a film extruded from a die having a profiled lip on both sides, the protrusions for forming the grooves 60 having heights which are preferably larger than the widths of these protrusions, the heights of the protrusions preferably being at least 1.5 times and more preferably about 2 times the widths of the protrusions measured at half the distance over which the respective protrusion projects.

The grooves 60 form interruptions of the HDPE layer 59 that protects the tape 54 from after-fibrillation. For use in an artificial ground cover, tape 54 having patterns of ribs 61 and grooves 60, preferably on both sides, provides the advantage that the tape 54 cleaves or after-fibrillates easily as is illustrated by the cleavage 62, and to some extent randomly, which is favorable for a natural look, but only or mainly along lines determined by the grooves 60, so that random after-fibrillation reducing the overall resilience of the lawn is to a large extent prevented. Cleaves in the profiled tape generally follow the webs between fibre bodies more closely than in tapes and yarns obtained from unprofiled film. Similarly, in tape with grooves 60 diametrically opposite of each other in opposite sides of the tape, cleaves tend to propagate across fibre bodies less frequently than in yarn or tape obtained from film which is profiled on one side only, so that the durability of the artificial turf is increased. The effect of local interruption of the protection against cleaving formed by the grooves can also be achieved with outer layers and core layers of other materials in which the outer layer protects the core layer from cleaving.

In the tape according to the present example, the grooves 60 extend over some distance in the core layer 58 as well. This provides further support for the cleave guiding effect of the grooves 60.

The longitudinal cleaving of the tapes obtained from the film 54 into a plurality of fibres or groups of fibres can for instance be carried out by submitting the tapes to a shear load and/or to a load having a transverse component. Cleaving in this manner can be carried out in a simple manner, for example by providing that successive rollers over which the tape 54 is guided are smoothly or stepwise tapered in opposite axial directions. Transversal tensile stress can for example be generated by providing rollers of which the circumferential surface has a shark-toothed or wavy shape in axial cross-section. Submitting the film or the tapes cut therefrom to shear loads or tensile load having a transverse component can also be carried out by twining tape-shaped film sections into yarns in a twining station (not shown).

A particular advantage is that the tuft may initially be uncleaved or only partially cleaved, which may have occurred during manufacture of the film and/or during processing of the film into tapes. This in turn allows to manufacture the ground cover with tufts each containing a very limited number of strands or even a single strand of tuft material, which facilitates production. The tuft material cleaves into a plurality of more grass-like strands during processing of the tape, by a special after-treatment such a high-speed brushing or combing and/or in use. This results in a structure in which the tape will be not or less cleaved in the area of the fabric 6 (FIG. 1) and being more cleaved further away from the fabric 6 to which the tape is fastened.

Accurate cleaving of the shown film 54 along webs formed by opposite pairs of grooves 60 is particularly enhanced by the feature that the grooves 60 have bottom regions including relatively sharp interior edges. These sharp interior edges increase stress concentrations in the webs formed by opposite pairs of grooves 60. Furthermore, the core layer 58 is preferably of a material that cleaves more easily than the outer layers 59.

Figure 4:
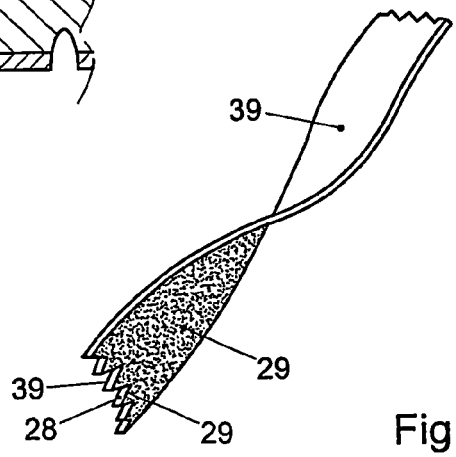
FIG. 4 is an enlarged perspective view of a short length sample of a further example of a monofilament yarn according to the invention.

In FIG. 4, a yarn having a flat cross-section and obtained from tape is shown having a core layer 28 and outer layers 29, 39. The outer layer 29 on one side of the yarn has a different colour than the outer layer 39 on the other side of the yarn. By providing an artificial turf with strands of flat yarn of which one side is of a different colour and/or tint than the other side, an artificial turf may be obtained which has a particularly attractive appearance. This effect can also be achieved if the yarn consists of other materials than the materials proposed above and even if the yarn consists of two layers or a single constructive layer. In the latter embodiment a colour needs to be applied to at least one side of the yarn.

The invention claimed is:

1. A yarn for strands of an artificial turf ground cover, including a tape filament having a core layer and two outer layers of a different material than the core layer and co-extruded with the core layer, each on one of two opposite sides of the core layer, wherein the core layer contains polyester and/or polyolefin material, the outer layers contain high-density polyethylene, the material of the tape filament has been stretched in longitudinal direction at a stretching ratio of 1:3-1:6, and the tape filament includes longitudinally extending grooves extending through at least one of the outer layers to the core layer.

2. A yarn according to claim 1, wherein the core layer contains polyethylene terephthalate or a polyolefin material from a group consisting of polypropylene, a mixture of polypropylene and rubber, a block copolymer of polypropylene and polyethylene and linear low density polypropylene.

3. A yarn according to claim 1, wherein the aggregated thickness of the outer layers is at most 50% of the thickness of the yarn.

4. A yarn according to claim 1, wherein the thickness of each of the outer layers is less than 50 μm.

5. A yarn according to claim 1, wherein the thickness of each of the outer layers is less than 20 μm.

6. A yarn according to claim 1, the yarn being of a monofilament tape construction.

7. A yarn according to claim 1, wherein the grooves are arranged pairwise diametrically opposite of each other in opposite sides of the tape filament.

8. A yarn according to claim 1, wherein the grooves have bottom portions extending into the core layer.

9. An artificial turf ground cover including a substrate sheet and strands fastened to the substrate sheet and projecting upwardly from the substrate sheet, wherein the strands are formed of a yarn according to claim 1.

10. An artificial turf ground cover including a substrate sheet and strands fastened to the substrate sheet and projecting upwardly from the substrate sheet, wherein the strands are formed of a yarn including a tape filament having a flat cross-section, one side of the tape filament having a color and/or tint different from the color and/or tint of the other side.

11. An artificial turf ground cover according to claim 10, wherein the strands are formed of a yarn including a tape filament having a core layer and two outer layers of a different material than the core layer and co-extruded with the core layer, each on one of two opposite sides of the core layer.

12. An artificial turf ground cover according to claim 10, wherein free ends of the strands project upwardly away from the substrate sheet.

13. An artificial turf ground cover according to claim 10, wherein the yarn consists of two layers.

* * * * *

UNITED STATES PATENT AND TRADEMARK OFFICE

CERTIFICATE OF CORRECTION

PATENT NO. : 7,611,763 B2
APPLICATION NO. : 10/558447
DATED : November 3, 2009
INVENTOR(S) : Atsma et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 617 days.

Signed and Sealed this

Twelfth Day of October, 2010

David J. Kappos

David J. Kappos
*Director of the United States Patent and Trademark Office*